US010167742B2

(12) United States Patent
Leu et al.

(10) Patent No.: US 10,167,742 B2
(45) Date of Patent: Jan. 1, 2019

(54) STEAM CYCLE, AND METHOD FOR OPERATING A STEAM CYCLE

(71) Applicant: Siemens Aktiengesellschaft, Munich (DE)

(72) Inventors: Bernd Leu, Meerbusch (DE); Martin Ophey, Straelen (DE); Klaus Rothe, Rees (DE); David Veltmann, Essen (DE); Kai Brune, Rheinberg (DE); Matthias Heue, Bochum (DE); Rudolf Pötter, Essen (DE); Michael Schütz, Kirchehrenbach (DE)

(73) Assignee: Siemens Aktiengesellschaft, Munich (DE)

( * ) Notice: Subject to any disclaimer, the term of this patent is extended or adjusted under 35 U.S.C. 154(b) by 88 days.

(21) Appl. No.: 15/306,545

(22) PCT Filed: Apr. 16, 2015

(86) PCT No.: PCT/EP2015/058308
§ 371 (c)(1),
(2) Date: Oct. 25, 2016

(87) PCT Pub. No.: WO2015/169562
PCT Pub. Date: Nov. 12, 2015

(65) Prior Publication Data

US 2017/0044935 A1 Feb. 16, 2017

(30) Foreign Application Priority Data

May 6, 2014 (EP) ..... 14167157

(51) Int. Cl.
*F01K 13/02* (2006.01)
*F01K 7/22* (2006.01)
*F01K 9/04* (2006.01)

(52) U.S. Cl.
CPC ..... *F01K 13/02* (2013.01); *F01K 7/22* (2013.01); *F01K 9/04* (2013.01)

(58) Field of Classification Search
CPC ..... F01K 13/02; F01K 7/22; F01K 9/04
(Continued)

(56) References Cited

U.S. PATENT DOCUMENTS 4,576,008 A 3/1986 Silvestri, Jr. et al.
4,691,086 A 9/1987 Habecker et al.
(Continued)

FOREIGN PATENT DOCUMENTS

EP 0178617 A1 4/1986
JP 2013050055 A 3/2013
(Continued)

OTHER PUBLICATIONS

KR Office Action dated Sep. 20, 2017, for KR patent application No. 10-2016-7033771.
(Continued)

*Primary Examiner* — Hoang Nguyen
(74) *Attorney, Agent, or Firm* — Beusse Wolter Sanks & Maire

(57) ABSTRACT

A steam cycle for a power station, and to a method for operating, in particular for starting, a steam cycle. The steam cycle has a high-pressure turbine, a condenser and a steam generator. The steam generator is connected to the high-pressure turbine via a first line. Live steam quick-closing valves and live steam regulating valves for supplying the high-pressure turbine are arranged in the direction of the steam flow between the steam generator and the high-pressure turbine. A starting line is arranged downstream of the high-pressure turbine in the direction of the steam flow, the starting line connecting a waste steam region downstream of the high-pressure turbine with the condenser. At
(Continued)

least one regulator regulates a closing of a starting valve for sealing the starting line, and an opening of the live steam valve, depending on the rotational speed, a temperature and load state of the high-pressure turbine.

14 Claims, 2 Drawing Sheets

(58) Field of Classification Search
USPC ..... 60/653, 646, 657, 660, 663
See application file for complete search history.

(56) References Cited

U.S. PATENT DOCUMENTS 4,693,086 A * 9/1987 Hoizumi ..... F01K 7/22 60/663
5,435,138 A 7/1995 Silvestri, Jr. et al.
5,473,898 A * 12/1995 Briesch ..... F01K 23/10 60/39.182
2009/0193787 A1* 8/2009 West ..... F01K 23/101 60/39.182
2010/0107636 A1* 5/2010 Panchatsaram ..... F01K 13/02 60/661
2010/0281877 A1* 11/2010 Asanaka ..... F01K 13/02 60/778
2011/0011057 A1* 1/2011 Bellows ..... F01K 13/02 60/39.182
2014/0000259 A1* 1/2014 Hermsdorf ..... F01K 3/24 60/646
2014/0165565 A1 6/2014 Shindo

FOREIGN PATENT DOCUMENTS

RU 35374 U1 1/2004
WO 2013031121 A 3/2013
WO 2013031121 A1 3/2013

OTHER PUBLICATIONS

JP Office Action dated Dec. 25, 2017, for JP patent application No. 2016566684.
EP Search Report dated Oct. 21, 2014, for EP application No. 14167157.8.
International Search Report dated Jun. 30, 2015, for PCT application No. PCT/EP2015/058308.
Kapelovich B.E., Operation of steam turbine units, M, 1975, pp. 42-43.
RU Search Report dated Feb. 26, 2018, for RU patent application No. 2016147413.

* cited by examiner

STEAM CYCLE, AND METHOD FOR OPERATING A STEAM CYCLE

CROSS REFERENCE TO RELATED APPLICATIONS

This application is the US National Stage of International Application No. PCT/EP2015/058308 filed Apr. 16, 2015, and claims the benefit thereof. The International Application claims the benefit of European Application No. EP14167157 filed May 6, 2014. All of the applications are incorporated by reference herein in their entirety.

FIELD OF INVENTION

The present invention relates to a steam circuit for a power plant, and to a method for operating a steam circuit.

BACKGROUND OF INVENTION

When starting up a steam turbine, the temperatures in the exhaust steam region of the high-pressure turbine can exceed permitted levels if the steam turbine is operated under little or no load, and little or no electricity is fed into the consumer grid. In order to lower the temperature, two measures are potentially conceivable: 1.) lowering the back-pressure of the high-pressure turbine; 2.) increasing the mass flow through the high-pressure turbine However, in start-up operation, under little or no load, it is not possible to increase the mass flow since this would increase the turbine output. For that reason, prior art steam turbines have, for start-up operation, what is termed a start-up line which connects a region downstream of the high-pressure turbine (also termed exhaust steam space) to the condenser of the steam turbine, and thus makes it possible to lower the back-pressure of the high-pressure turbine.

In prior art steam turbines, switching from start-up operation or no-load operation to output operation involves closing the start-up line. It is necessary to close the start-up line because the mass flow of the steam which is fed to the condenser via the start-up line is not available for cooling the reheat.

Closing the start-up line raises the pressure at the outlet of the high-pressure turbine and thus the outlet temperature of the high-pressure turbine. An impermissible temperature rise after closing of the start-up line can be prevented by simultaneously increasing the mass flow through the high-pressure turbine.

In that context, closing the start-up line too rapidly leads to pressure fluctuations in the water/steam circuit, which can even lead to emergency shutdown of the turbine.

Increasing the mass flow through the high-pressure turbine too slowly during closing of the start-up line leads to impermissibly high temperatures in the exhaust steam region downstream of the high-pressure turbine.

These two conditions require the closing of the start-up line and the opening of the live steam valves to be optimally reconciled in order on one hand to be able to rapidly increase the mass flow of the steam via the live steam valves, and thus to keep the temperature low, and on the other hand to limit the mass flow via the start-up line in order that the reheat is sufficiently supplied and a so-called high-pressure redirection station can adjust the live steam pressure.

Hitherto, this object has been achieved by quick closing of the start-up line and anticipated control to the high-pressure redirection station. However, this approach leads to a highly transient temperature in the exhaust steam region of the high-pressure turbine, and to a highly transient mass flow in the turbine, in the live steam line and in the line to the reheat.

WO 2013/031121 A1 discloses a steam turbine device and a method for operating same, wherein start-up of the steam turbine is controlled by means of an overflow line system.

SUMMARY OF INVENTION

An object of the invention is to make the start-up process "gentler" and smoother, and thus to reduce the load on the components.

This object is achieved with a steam circuit and a method for operating a steam circuit according to the independent claims.

The inventive steam circuit, and the inventive method for operating a steam circuit have the advantage over the prior art that a controller is provided and controls closing of the valve for sealing the start-up line and opening the live steam valves such that 1.) The exhaust steam temperature downstream of the high-pressure turbine always remains within permissible limits. 2.) The demands on the high-pressure redirection station are not increased. 3.) The reheater always has a sufficient supply of steam. 4.) The water/steam circuit is subject to only minor mass flow fluctuations.

Advantageous refinements of and improvements to the steam turbine, and the method for operating a steam turbine, indicated in the independent claim are made possible by the measures set out in the dependent claims.

One advantageous refinement of the steam circuit consists in the controller for closing the start-up valve and the controller for opening the live steam valves being integrated into a common module. In dependence on the operating variables "pressure", "temperature" and "speed", which are detected by corresponding sensors, the common controller can control the opening of the live steam valves and the closing of the start-up valve.

Another advantageous refinement is that the start-up line branches off between the high-pressure turbine and the reheater, and opens into the condenser. Thus, the start-up line ensures a direct connection between the exhaust steam region and the condenser, such that the steam from the exhaust steam region can be removed without further intermediate elements.

Another advantageous refinement is that there is provided, in a line section between the high-pressure turbine and the reheater, a check device which prevents the steam flowing back toward the high-pressure turbine. Such a check device reliably ensures that, in no operating state, steam from the reheater flows back into the high-pressure turbine, possibly causing emergency shutdown of the turbine. A check flap is a particularly simple and effective check device.

Another advantageous refinement is that another line is arranged parallel, at least in sections, to the start-up line and also connects the high-pressure turbine or the exhaust steam region to the condenser.

One inventive refinement to the method is that the pressure of the steam upstream of the inlet into the high-pressure turbine, in particular into a blading space of the high-pressure turbine, is raised in a time-delayed and continuous manner. Stepwise raising of the pressure makes the mass flow through the high-pressure turbine simple to control.

Another advantageous refinement is that raising the pressure of the steam upstream of the inlet into the high-pressure turbine, in particular upstream of the inlet into the blading space, takes place at a defined position of the start-up valve. A defined position of the start-up valve, which partially closes the start-up line, can limit the mass flow through the start-up line and can thus be used as another controlling variable.

Alternatively or in addition, opening of the live steam valves can be controlled via the raising of the setpoint pressure value at a pressure-limiting controller upstream of the inlet into the high-pressure turbine or into the blading space. Defined opening of the live steam valves with a simultaneously defined position of the start-up valve makes it possible for the mass flow through the high-pressure turbine to be controlled with greater precision.

BRIEF DESCRIPTION OF THE DRAWINGS

There follows a more detailed explanation of an exemplary embodiment of an inventive steam turbine and of an inventive method for operating, in particular for starting up, such a steam turbine, with reference to the appended drawings. In that context, identical components or components having identical functions are labeled with identical reference signs.

DETAILED DESCRIPTION OF INVENTION

Figure 1:
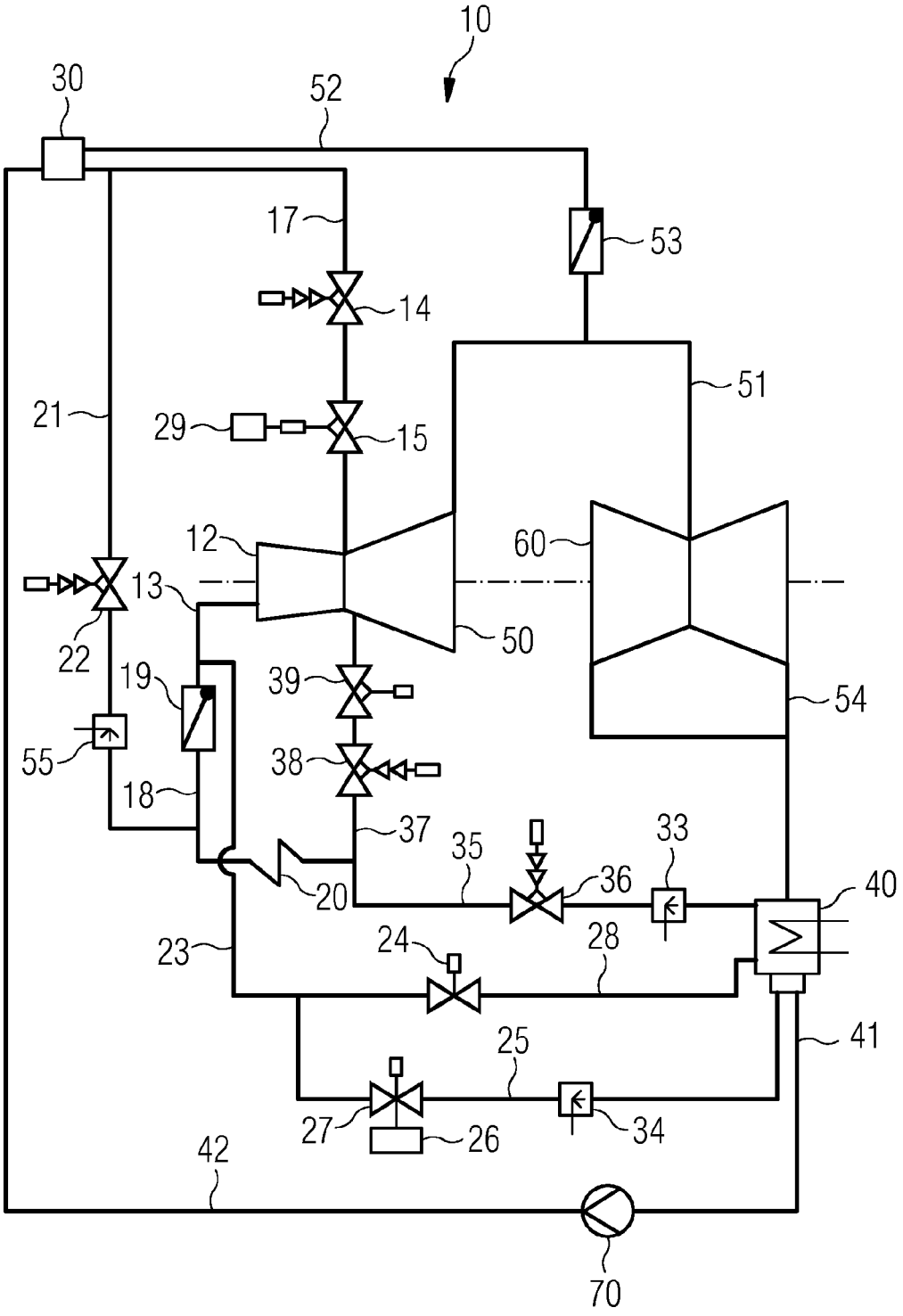
FIG. 1 shows a schematic representation of a steam circuit according to the invention.

FIG. 1 shows a steam circuit 10 having a high-pressure turbine 12, an intermediate-pressure turbine 50 and a low-pressure turbine 60. The turbines (12, 50, 60) are arranged on a common shaft which is coupled to a generator (not shown). The steam circuit 10 further comprises a steam generator 30, a condenser 40 and a feed pump 70. The steam generator 30 is connected to the high-pressure turbine 12 via a first line 17, wherein live steam valves 14, 15, which can prevent a flow of steam from the steam generator 30, are arranged on the first line 17. In that context, the live steam valve 14 acts as a live steam quick-closing valve and the live steam valve 15 acts as a live steam controlling valve. A pressure-limiting controller 29 is arranged at the live steam valve 15 and can be used to limit the mass flow of the steam from the steam generator 30 to the high-pressure turbine 12. An exhaust steam region 13 is connected downstream of the high-pressure turbine 12 and is supplied with steam leaving the outlet of the high-pressure turbine 12. The exhaust steam region 13 is connected, via a line section 18 in which there is arranged a check flap 19, to a reheater 20. The reheater 20 is connected, via a line 37 in which there are arranged live steam valves 38, 39 for blocking or controlling the supply of steam, to the intermediate-pressure turbine 50. The reheater 20 is further connected to the condenser 40 via a line 35, wherein in the line 55 there is arranged an intermediate-pressure redirection station 36 with a downstream-connected injection device 33 by means of which it is possible to control the supply of pressure to the intermediate-pressure turbine 50.

The steam generator 30 is further connected, via a line 21 in which there are arranged a high-pressure redirection station 22 and an injection device 85, to the reheater 20. The exhaust steam region 13 is connected to the condenser 40 via a start-up line 23, 25. In that context, a start-up valve 27 and an injection device 34 are arranged in the start-up line 25. The start-up valve 27 can be controlled by means of a controller 26 and can be partially opened at least in discrete intermediate steps between the "fully open" and "fully closed" positions. Alternatively, a fully controllable start-up valve 27 would also be possible. In addition, an emptying line 28 is arranged parallel to the start-up line 25 and also opens into the condenser 40. The emptying line can be opened by means of an emptying valve 24.

The steam generator 30 is connected to the low-pressure turbine 60 via a line 52, wherein a controlling flap 53 is arranged in the line 52 and controls the supply of steam to the low-pressure turbine 60. The intermediate-pressure turbine 50 is connected to the low-pressure turbine 60 via a line 51, wherein the line 52 opens into the line 51. A line 54 leads from the low-pressure turbine 60 to the condenser 40, which is in turn connected to the feed pump 70 via a line 41. The feed pump 70 is connected to the steam generator 30 via a line 42.

During operation of the steam circuit 10, the steam generator 30 is supplied with water via the pressurizing feed pump 70 and the line 42. In the steam generator 30, the water is evaporated and superheated. This steam is fed via the first line 17 to the high-pressure turbine 12, where the steam is partially expanded. In the reheater 20, the steam is again supplied with energy, which it gives off via the intermediate-pressure turbine 50 and the low-pressure turbine 60. The expanded steam then condenses in the condenser 40 and is fed, via the line 41, back to the steam generator 30 as water, thus closing the circuit.

The respective injection devices 33, 34, 55 can be used to add water to the steam in the lines 21, 25 and 28 in order to lower the temperature of the steam at the inlet into the condenser 40, or into the reheater 20. A controller 26 is provided at the start-up valve 27 and opens the start-up valve 27 in dependence on temperature, pressure and speed of the high-pressure turbine 12. The corresponding sensors for detecting the speed are not shown, but can easily be arranged on the shaft which carries the turbine stages 12, 50, 60 and is connected to the generator.

The sensors for detecting the temperature and the pressure are sensibly arranged upstream of the inlet into the blading space of the high-pressure turbine 12 or at the outlet of the high-pressure turbine 12, or in the exhaust steam region 13.

Figure 2:
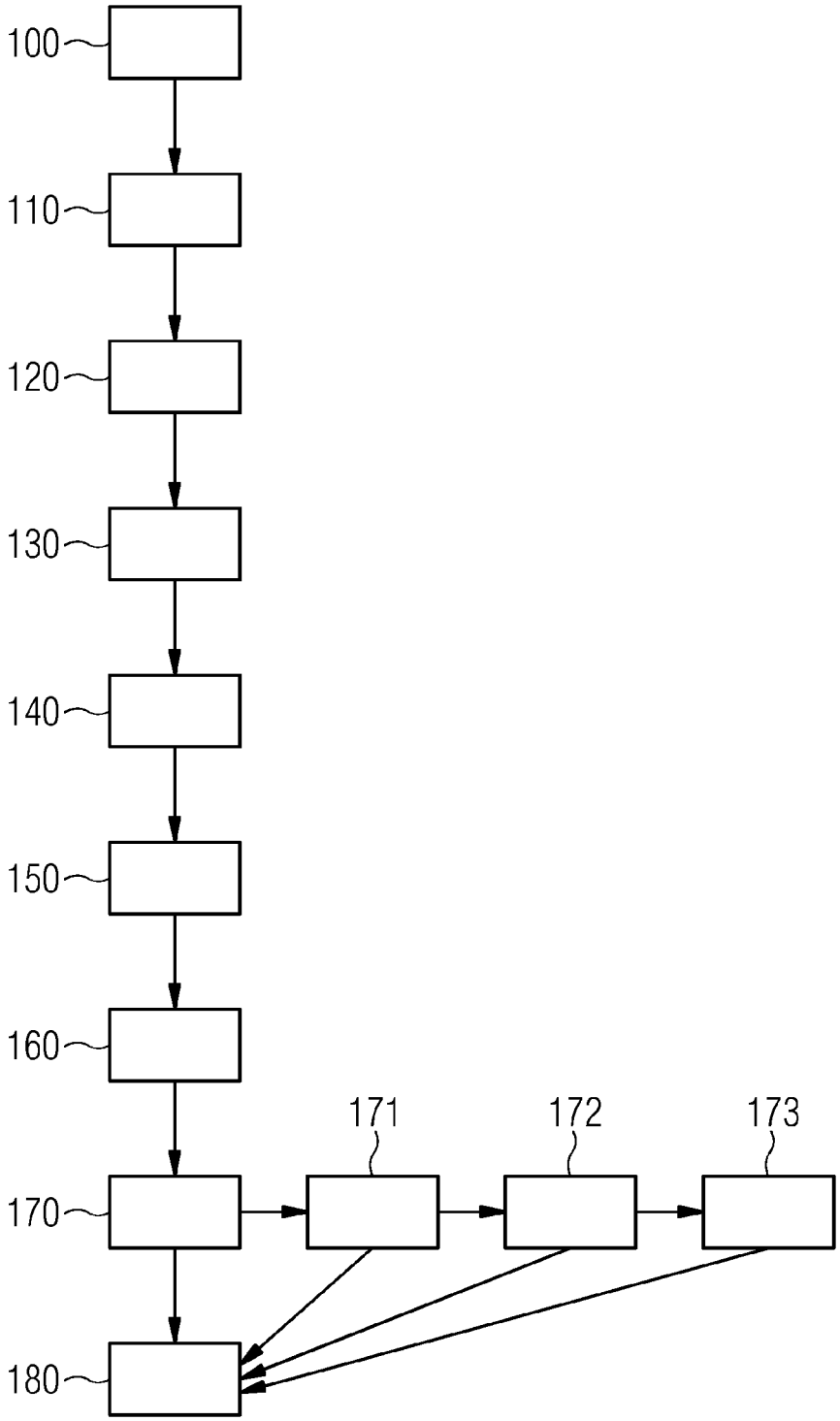
FIG. 2 shows a flowchart of a method, according to the invention, for operating a steam circuit.

FIG. 2 shows a flowchart for starting up a steam circuit having a steam turbine.

A first method step [100] involves beginning a start-up procedure for the steam turbine 12, 50, 60. In a further method step [110], the steam turbine 12, 50, 60 is accelerated by fully opening the live steam quick-closing valves 14, 38 and subsequently opening the live steam valves 15, 39. In a subsequent method step [120], the start-up line 25 is opened by opening the start-up valve 27 and the pressure-limiting controller 29 is activated. In the next method step [130], a warm-up speed is reached and the steam turbine 12, 50, 60 is accelerated further to the rated speed.

The following method step [140] involves operating the steam turbine under no load and synchronization with the grid. In the next method step [150], the output of the steam turbine 12, 50, 60 is further increased until a mass flow of the steam through the high-pressure turbine 12, without a pressure-limiting controller 29, would be so great that with the start-up line 25 closed an exhaust steam temperature downstream of the high-pressure turbine 12 is still just permissible. In the following method step [160], the closing procedure of the start-up valve 27 for closing the start-up line 25 begins. Starting at a defined position of the start-up valve 27, in the subsequent method steps [170], [171], [172], [173] a setpoint pressure value of the pressure-limiting controller 29 is raised in a time-delayed and continuous manner, at a defined rate. This effects defined opening of the fresh steam valves 15, 39. This procedure is continued until the mass flow of the steam through the high-pressure turbine 12 has exceeded a threshold value. In a final method step [180], the start-up line 25, or the start-up valve 27, is fully closed and the steam turbine 12, 50, 60 is switched to output operation.

Although the invention has been described in detail by way of the preferred exemplary embodiments, the invention is not restricted to the disclosed exemplary embodiment and other variations can be derived herefrom by a person skilled in the art without departing from the scope of protection of the invention.

The invention claimed is:

1. A steam circuit for a power plant, comprising:

a high-pressure turbine, a condenser and a steam generator, wherein the steam generator is connected to the high-pressure turbine via a first line, wherein, in the flow direction of the steam, at least one live steam valve is arranged between the steam generator and the high-pressure turbine, and wherein, in the flow direction of the steam, a start-up line is arranged downstream of the high-pressure turbine and connects an exhaust steam region downstream of the high-pressure turbine to the condenser, at least one controller which, in dependence on operating parameters of the high-pressure turbine, controls closing of a start-up valve for closing the start-up line and opening of the at least one live steam valve, wherein opening of the start-up valve is controllable, at least stepwise, between the positions "fully open" and "fully closed", and a setpoint pressure value of the controller is raised in dependence on the opening of the start-up valve.

2. The steam circuit as claimed in claim 1, wherein the operating parameters of the high-pressure turbine are a rotational speed, a temperature, a pressure and/or a load state of the high-pressure turbine.

3. The steam circuit as claimed in claim 1, wherein the controllers are integrated into a common module.

4. The steam circuit as claimed in claim 1, further comprising:

a reheater provided between the high-pressure turbine and a further turbine stage.

5. The steam circuit as claimed in claim 4, wherein the start-up line branches off between the high-pressure turbine and the reheater, and opens into the condenser.

6. The steam circuit as claimed in claim 4, further comprising:

a check device in a line section between the high-pressure turbine and the reheater, which prevents the steam flowing back toward the high-pressure turbine.

7. The steam circuit as claimed in claim 1, further comprising:

another line arranged parallel, at least in sections, to the start-up line and also connects the high-pressure turbine to the condenser.

8. A method for operating, a steam circuit having a high-pressure turbine, a condenser and a steam generator, the method comprising:

beginning a start-up procedure of the steam turbine, accelerating the steam turbine by opening live steam valves, opening a start-up line and activating a pressure-limiting controller, accelerating the steam turbine to its rated speed, operating the steam turbine in no-load operation and synchronization with the grid, increasing the output of the steam turbine, until a steam mass flow through the high-pressure turbine reaches a threshold value, beginning the procedure of closing the start-up line by closing a start-up valve, from a defined position of the start-up valve, controlled raising of the pressure upstream of the inlet into the high-pressure turbine by means of the pressure-limiting controller, and ending the procedure of closing the start-up line by fully closing the start-up valve and transition of the steam turbine into output operation.

9. The method as claimed in claim 8, wherein the pressure upstream of the inlet into the high-pressure turbine is raised in a time-delayed and continuous manner, at a predefined rate.

10. The method as claimed in claim 9, wherein raising the pressure upstream of the inlet into the high-pressure turbine takes place at a defined position of the start-up valve.

11. The method as claimed in claim 10, wherein opening of the live steam valves is controlled via the raising of a setpoint pressure value at the pressure-limiting controller upstream of the inlet into the high-pressure turbine.

12. The steam circuit as claimed in claim 2, wherein the temperature comprises the temperature in the exhaust steam region.

13. The steam circuit as claimed in claim 6, wherein the check device comprises a check flap.

14. The steam circuit as claimed in claim 7, wherein the another line comprises a line for emptying the high pressure turbine.

* * * * *